US005483123A

United States Patent [19]

Walker et al.

[11] Patent Number: 5,483,123

[45] Date of Patent: Jan. 9, 1996

[54] HIGH IMPEDANCE ANODE STRUCTURE FOR INJECTION LOCKED MAGNETRON

[75] Inventors: Christopher M. Walker, Montoursville, Pa.; Geoffrey Thornber, Aptos, Calif.

[73] Assignee: Litton Systems, Inc., Beverly Hills, Calif.

[21] Appl. No.: 55,823

[22] Filed: Apr. 30, 1993

[51] Int. Cl.[6] ..... H01J 23/18; H01J 23/22

[52] U.S. Cl. ..... 315/39.73; 315/39.75; 315/39.69

[58] Field of Search ..... 315/39.51, 39.69, 315/39.73, 39.75

[56] References Cited

U.S. PATENT DOCUMENTS

| | | | |
|---|---|---|---|
| 2,860,285 | 11/1958 | Smith | 315/39.69 X |
| 2,866,920 | 12/1958 | Haagensen | 315/39.63 |
| 2,953,715 | 9/1960 | Kumpfer | 315/39.75 |
| 2,992,362 | 7/1961 | Boyd | 315/39.75 |
| 3,305,693 | 2/1967 | Hull | 315/39.69 |
| 4,056,756 | 11/1977 | Derby | 315/39.69 |
| 4,287,451 | 9/1981 | Koinuma et al. | 315/39.69 |
| 4,644,225 | 2/1987 | Aiga et al. | 315/39.51 |
| 4,720,659 | 1/1988 | Aiga et al. | 315/39.69 |
| 5,045,814 | 9/1991 | English et al. | 315/39.51 X |

FOREIGN PATENT DOCUMENTS

| | | | |
|---|---|---|---|
| 0519803A1 | 12/1992 | European Pat. Off. . | |
| 230637 | 9/1990 | Japan | 315/39.75 |
| 1009870 | 11/1965 | United Kingdom . | |
| 2173636 | 10/1986 | United Kingdom . | |
| 2176049 | 12/1986 | United Kingdom . | |
| 2238422 | 5/1991 | United Kingdom . | |
| 2266180 | 10/1993 | United Kingdom . | |

OTHER PUBLICATIONS

"A Study of Locking Phenomena in Oscillators" by Robert Adler, Proceedings of the IEEE, vol. 61, No. 10, Oct. 1973, pp. 1380–1385.

"Synchronization of Oscillators" by Robert D. Huntoon and A. Weiss, Proceedings of the I.R.E., Dec. 1947, pp. 1415–1423.

"RF Phase Control in Pulsed Magnetrons" by E. D. David, Jr., Proceedings of the I.R.E., Jun. 1952, pp. 669–685.

*Primary Examiner*—Benny T. Lee

*Attorney, Agent, or Firm*—Graham & James

[57] ABSTRACT

An anode structure of the present invention provides radially disposed first vanes and radially disposed second vanes interdigitating with the first vanes. The first vanes and the second vanes are each interconnected by a first strap and a second strap, respectively. The first strap and the second strap are disposed coaxially on the same side of the vane structure and are generally rectangular in cross-section, having substantially parallel facing surfaces. Each of the vanes is generally T-shaped, with a relatively wide high capacitive first portion and a relatively narrow high inductive second portion. The first portion is disposed proximate to an axis of the cavity with the second portion extending radially outward therefrom. The anode structure has at least thirty anode vanes.

12 Claims, 2 Drawing Sheets

FIG. 1
PRIOR ART
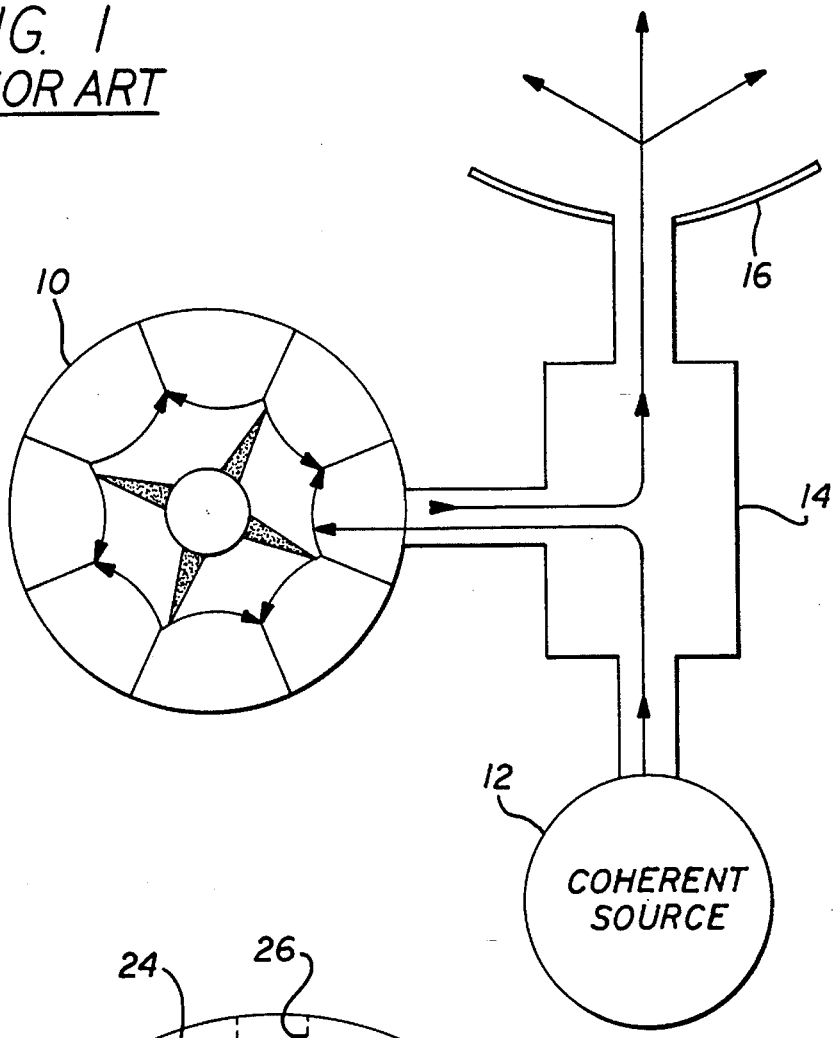
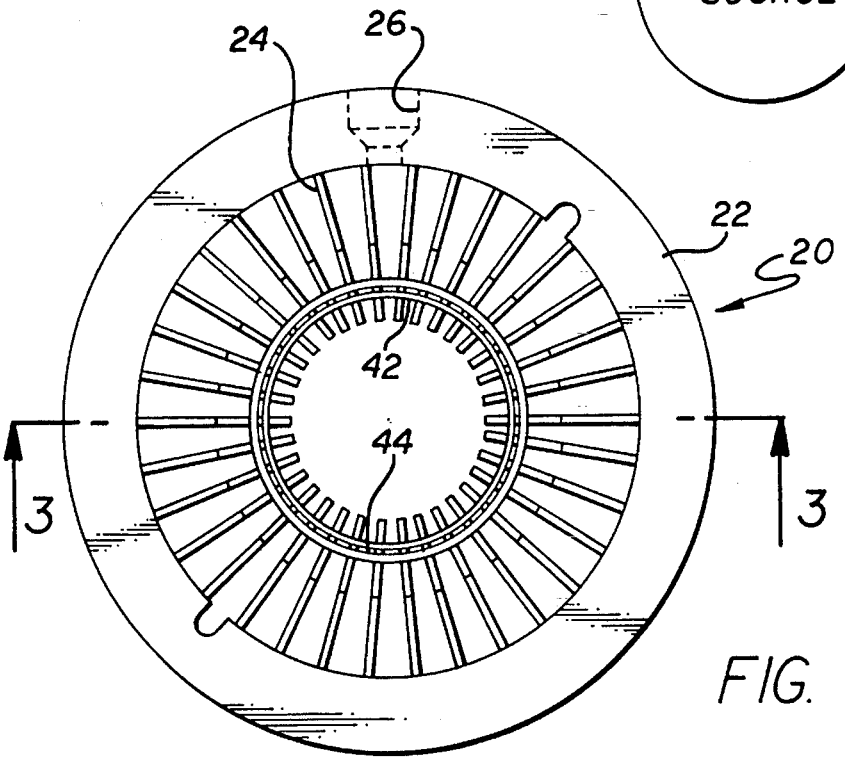
FIG. 2

FIG. 3
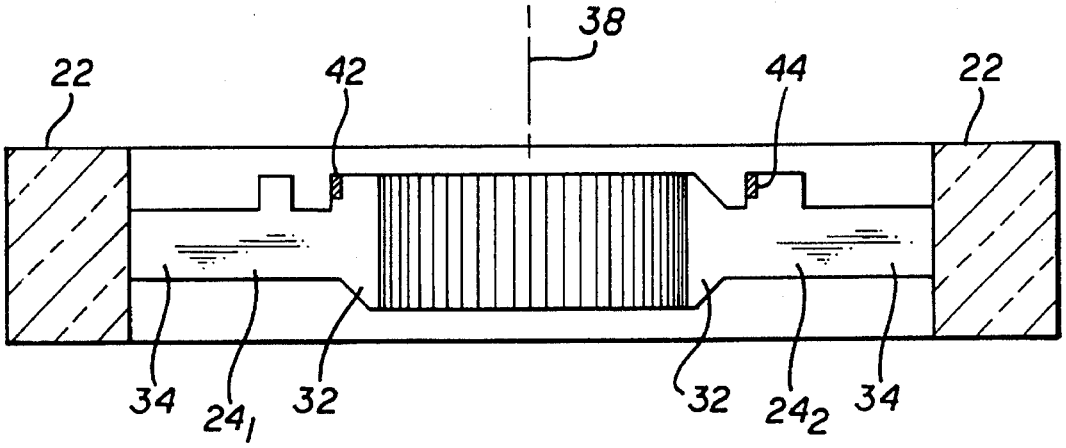
FIG. 4
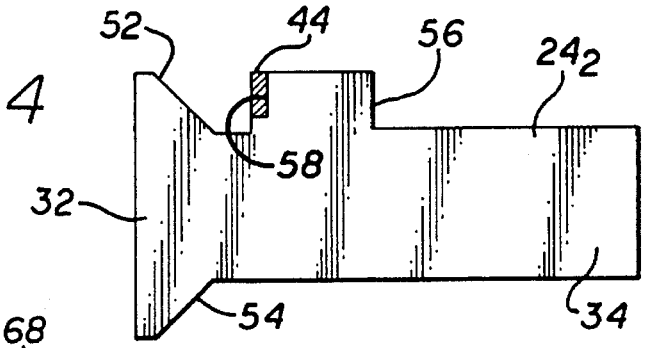
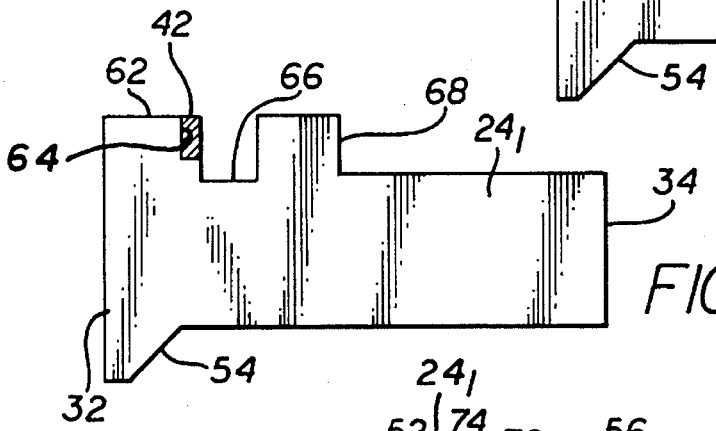
FIG. 5
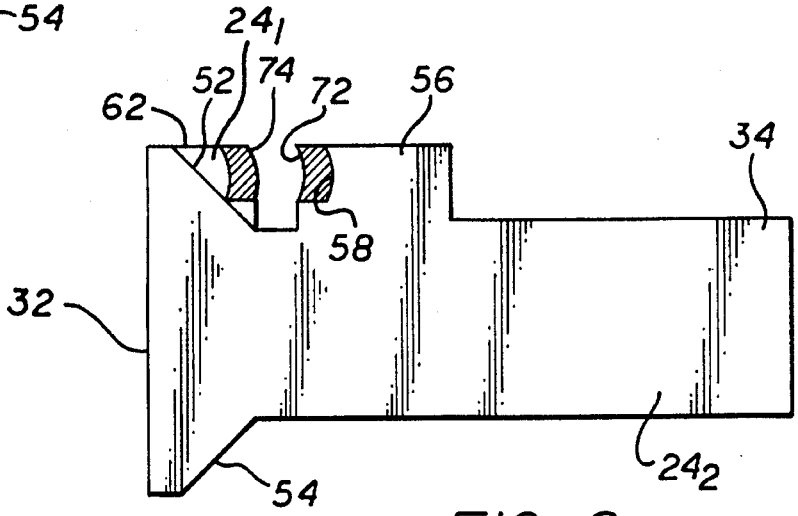
FIG. 6

HIGH IMPEDANCE ANODE STRUCTURE FOR INJECTION LOCKED MAGNETRON

BACKGROUND OF THE INVENTION

1. Field of the Invention

The present invention relates to injection locked magnetrons and, more particularly, to a high impedance anode structure utilizing a novel vane configuration.

2. Description of Related Art

Magnetrons have been used for several years in electronic systems that require high RF power, such as radar systems. A magnetron typically includes a central cylindrical shaped cathode coaxially disposed within an annular anode structure with an interaction region provided between the cathode surface and the anode. The anode structure may include a network of vanes which provides a resonant cavity tuned to provide a mode of oscillation for the magnetron.

Upon application of an electric field between the cathode and the anode, the cathode surface emits a space-charge cloud of electrons. A magnetic field is provided along the cathode axis, perpendicular to the electric fields, which causes the emitted electrons to spiral into cycloidal paths in orbit around the cathode. When RF fields are present on the vane structure, the rotating space-charge cloud is concentrated into a spoke-like pattern. This is due to the acceleration and retardation of electrons in regions away from the spokes. The electron bunching induces high RF voltages on the anode circuit, and the RF levels on the anode build up until the magnetron is drawing full peak current for any given operating voltage. Electron current flows through the spokes from the cathode to the anode, producing a high power RF output signal at the desired mode of oscillation.

One particular type of magnetron, known as an injection locked magnetron, utilizes an external oscillator to inject a sinusoidal signal into the anode structure of the magnetron at a frequency close to its natural resonant frequency. These injection locked magnetrons can then be caused to operate in the $\pi$ mode of oscillation at a precise frequency determined by the external oscillator. The advent of higher power solid state oscillators has increased the feasibility of injection locked magnetrons. Injection locked magnetrons are further described in U.S. Pat. No. 5,045,814, by English et al., which is assigned to the common assignee, and which is incorporated herein by reference.

It has long been desirable in magnetrons to increase the size of the cathode so as to increase the output power of the magnetron. Enlarging the cathode would enable the magnetron to produce the same amount of power while decreasing the current density on the cathode surface, known as cathode loading. The lower the cathode loading, the longer the lifetime of the cathode. Since cathode degradation is a significant cause of magnetron failure, it is highly desirable to increase the life of the cathode. In addition, reducing the cathode loading would reduce the thermal loading on the anode structure, further improving the reliability and life of the magnetron.

A significant problem with this approach is that it has not been possible to build a large diameter cathode magnetron in actual practice. Traditionally, magnetrons have a limited number of anode vanes, such as twelve or eighteen, which form the resonant cavity and determine the modes of oscillation. As the cathode diameter increases, the anode diameter also needs to increase. This causes the distance between adjacent vane tips proximate to the cathode surface to become too large, and the orbiting electrons would not be synchronized to the RF field. As a result, the magnetron will no longer oscillate at the desired peak power level.

To keep the adjacent vane tips at acceptable distances for proper oscillation to occur, a large diameter cathode magnetron would require a higher number of anode vanes. However, as the number of vanes is increased, the overall impedance of the anode structure decreases and the magnetron becomes unstable. The mode separation becomes so small that oscillation cannot be maintained at a desired mode. For these reasons, magnetrons having greater than 30 anode vanes are generally considered impractical. If the impedance of the anode structure could be maintained at a high level, the number of anode vanes could be increased and the cathode diameter could be enlarged.

Accordingly, a need exists to provide an anode structure for a magnetron having a relatively high impedance to permit an increased number of anode vanes. Ideally, the anode structure would provide increased mode separation over conventional magnetrons.

SUMMARY OF THE INVENTION

In addressing these needs and deficiencies of the prior art, a high impedance anode structure for an injection locked magnetron is provided. The anode structure provides a very high inductive and low capacitive circuit, so as to increase the single cavity impedance of the magnetron.

The anode structure of the present invention comprises radially disposed first vanes and radially disposed second vanes interdigitating between the first vanes. The first vanes and the second vanes are each interconnected by a first strap and a second strap, respectively. The first strap and the second strap are disposed coaxially on the same side of the vane structure and are generally rectangular in cross-section. The vanes and straps are dimensioned so that the circuit has a single cavity impedance commensurate with a predetermined interaction impedance for the magnetron which is sufficient to sustain oscillation for a preselected injection locking bandwidth of the oscillator.

More particularly, each of the vanes is generally T-shaped. Each vane has a relatively wide high capacitive first portion disposed proximate to an axis of the cavity and a relatively narrow high inductive second portion extending radially outward therefrom. The first portion is relatively short with respect to the overall length of the vane, giving the vane a relatively low total capacitance. The combination of low capacitance with high inductance produces the desired high interaction impedance, enabling the use of at least thirty anode vanes in the anode structure.

A more complete understanding of the high impedance anode circuit for an injection locked magnetron will be afforded to those skilled in the art, as well as a realization of additional advantages and objects thereof, by a consideration of the following detailed description of the preferred embodiment. Reference will made to the appended sheets of drawings which will first be described briefly.

BRIEF DESCRIPTION OF THE DRAWINGS

FIG. 1 is a schematic diagram of a typical magnetron oscillator circuit used in the prior art;

FIG. 2 is a top view of an anode circuit constructed in accordance with the principles of the present invention;

FIG. 3 is a side view taken along line 3—3 of FIG. 2;

FIG. 4 is an enlarged side view of a first anode vane;

FIG. 5 is an enlarged side view of a second anode vane; and

FIG. 6 is an enlarged side view of an anode vane having a crescent shaped anode strap.

DETAILED DESCRIPTION OF THE PREFERRED EMBODIMENT

The present invention provides a high impedance anode structure for a magnetron which permits an increased number of anode vanes. The anode structure would also provide increased mode separation over conventional magnetrons.

Referring first to FIG. 1, there is shown a schematic diagram illustrating the use of an injection locked magnetron 10. A source 12 of coherent microwave energy delivers a low power sinusoidal signal to a circulator 14. The source 12 may include a solid state dielectric resonator. The circulator injects the low power signal into the magnetron 10. The low power signal is amplified by the magnetron 10 as is well-known in the art. The amplified energy developed by the magnetron 10 is then redirected back to the circulator 14. The high power microwave energy is then coupled to an antenna 16 to radiate the high power coherent output energy.

Referring next to FIG. 2, a high impedance anode circuit 20 for the magnetron 10 is illustrated. The circuit 20 includes an anode ring 22 and a plurality of radial anode vanes 24 which extend inwardly from the anode ring. A port 26 extends radially through a portion of the anode ring 22, and provides a path for the injected low power signal and the amplified output signal.

The radial anode vanes 24 include a plurality of first radial vanes $\mathbf{24_1}$ and a plurality of second radial vanes $\mathbf{24_2}$, illustrated in FIGS. 3–5. The first radial vanes $\mathbf{24_1}$ are interdigital with the second radial vanes $\mathbf{24_2}$. Each of the first vanes $\mathbf{24_1}$ and second vanes $\mathbf{24_2}$ has a relatively wide first portion 32 and a relatively narrow second portion 34. The first portion 32 is radially proximate to an axis 38 (see FIG. 3) of the anode ring 22 about which the magnetron cathode is disposed, and is relatively short with respect to the overall length of the vane 24.

The width of the first portion 32 is generally equivalent to uniform width vanes typically found in the art, and provides a relatively high capacitance region. The second portion 34 provides a high inductance region which has reduced capacitance. The combination of the wide first portion 32 with the narrow second portion 34 produces a generally T-shaped anode vane 24 which provides unique characteristics over conventional vanes having uniform width. By keeping the first portion 32 relatively short, the vanes 24 have a relatively low total capacitance. The narrow second portion 34 concentrates magnetic field lines around the vane 24 to create a high inductance region. The low vane capacitance coupled with the high inductance yields a relatively high circuit impedance.

The anode circuit 20 further includes a first strap 42 and a second strap 44. Each of the first strap 42 and the second strap 44 are coaxial with the axis 38 (see FIG. 3), and are both disposed along a single side of the first and second vanes $\mathbf{24_1}$ and $\mathbf{24_2}$. The first strap 42 interconnects the first vanes $\mathbf{24_1}$ and the second strap 44 interconnects the second vanes $\mathbf{24_2}$. The straps 42 and 44 each have a generally rectangular cross-section.

As illustrated in FIG. 5, the first anode vanes $\mathbf{24_1}$ have a generally wide first portion 32 and a narrow second portion 34. A lower tapered portion 54 reduces the width of the vane $\mathbf{24_1}$ from the width of the first portion 32 to the width of the second portion 34. Opposite the lower tapered portion 54, a tab portion 62 extends axially to a dimension equivalent to that of the first portion 32. A first channel 64 is disposed in the tab portion 62, providing an attachment point for the first strap 42. A space 66 is provided adjacent the tab portion 62 to permit passage of the second strap 44. A second tab portion 68 extends upwardly relative the second narrow portion 34, and lies on an arc encompassing the tab portion 56 of the second anode vane $\mathbf{24_1}$, illustrated in FIG. 4 as described below. The first strap 42 may be soldered into the channel 58 by conventional techniques, and the second portion 34 may be soldered to the anode ring 22.

As illustrated in FIG. 4, the second anode vanes $\mathbf{24_2}$ also have a generally wide first portion 32 and a narrow second portion 34. An upper tapered portion 52 and lower tapered portion 54 reduce the width of the vane $\mathbf{24_2}$ from the width of the first portion 32 to the width of the second portion 34. The upper tapered portion 52 provides access for passage of the first strap 42. A tab portion 56 extends from the narrow second portion 34 to an axial dimension equivalent to that of the first portion 32. A first channel 58 is disposed in the tab portion 56, providing an attachment point for the second strap 44. The strap 44 may be soldered into the channel 58 by conventional techniques, and the second portion 34 may be soldered to the anode ring 22.

The use of straps is known to generally improve mode separation in a magnetron. In the desired $\pi$ mode of operation, alternate anode vanes 24 are at the same RF potential. The electric field between the vanes reverses direction between each of the first vanes $\mathbf{24_1}$ and the second vanes $\mathbf{24_2}$. By connecting the alternate anode vanes 24 together by straps 42 and 44, no additional inductance will be introduced since the ends of the straps are at the same potential. Typically, the straps add capacitance to the anode circuit 20, so the $\pi$ mode frequency will be altered. In modes other than the $\pi$ mode, the voltage differences between alternate anode vanes 24 is not zero, so the straps introduce inductance as well as capacitance resulting in different frequency shifts than occur for the $\pi$ mode. Thus, the undesired modes are shifted to frequencies far enough removed from the $\pi$ mode that the magnetron can be prevented from operating in these modes.

In the present invention, the shape and proximity of straps 42 and 44 have been found to further improve the mode separation between the $\pi$ and the $\pi$–1 modes over that of conventional anode straps. The rectangular cross-section of the straps and their position in close facing proximity prevents the $\pi$–1 mode from becoming stable. Although the rectangular straps have slightly higher capacitance over circular straps, this disadvantage is more than compensated for by the resultant improvement in mode separation.

Alternative shapes for the straps 42 and 44 have also been found to be effective at improving the mode separation over circular cross-section straps, such as a crescent shape or elliptical shape. To obtain the benefit, the straps should have facing surfaces that are generally parallel and approximately equivalent in height and separation distance. FIG. 6 illustrates a second anode vane $\mathbf{24_2}$ (having the same labelled features as described above with respect to FIG. 4) having a crescent shaped second strap 72 disposed in the foreground of a first anode vane $\mathbf{24_1}$ (having the same labelled features as described above with respect to FIG. 5) having a first crescent shaped strap 74. The crescent shaped strap can be produced by deforming the rectangular strap shape to introduce the desired curvature.

Each of the vanes $\mathbf{24_1}$, $\mathbf{24_2}$, the first strap 42, and second strap 44 are dimensioned so that the circuit 20 has a single cavity impedance commensurate with a predetermined interaction impedance for the magnetron which is sufficient to sustain magnetron oscillation for a preselected injection locking bandwidth. The use of the high impedance T-shaped anode vanes 24 enable a greater number of vanes to be utilized without reducing the overall mode stability. This feature permits the production of magnetrons having greater than thirty vanes. In an embodiment of an injection locked magnetron, an anode circuit having thirty four vanes has been successfully demonstrated.

Having thus described a preferred embodiment of a high impedance anode circuit for an injection locked magnetron, it should be apparent to those skilled in the art that certain advantages of the within system have been achieved. It should also be appreciated that various modifications, adaptations, and alternative embodiments thereof may be made within the scope and spirit of the present invention. For example, an injection locked magnetron has been illustrated, but it should be apparent that the inventive concepts described above would be equally applicable to other magnetron types. The invention is further defined by the following claims.

What is claimed is:

1. A high impedance anode circuit for a magnetron, comprising:

a plurality of first radial vanes disposed in and extending from an anode ring;

a plurality of second radial vanes, interdigitating with said first vanes, and disposed in and extending from said anode ring to define a vane structure;

a first strap interconnecting said plurality of first vanes;

a second strap interconnecting said plurality of second vanes, said first and second straps each having a respective rectangular cross-section with corresponding parallel facing surfaces;

said plurality of first and second vanes each having a respective high inductance portion adjacent said anode ring and a respective high capacitance portion extending from said high inductance portion, said high inductance portion being longer than said high capacitance portion so that said circuit provides a high single cavity impedance.

2. The high impedance circuit of claim 1, wherein said first and second straps are disposed on a same side of said vanes.

3. The high impedance circuit of claim 1, wherein there are at least thirty of said anode vanes.

4. The high impedance circuit of claim 1, wherein said first and second straps each have a respective crescent-shaped cross-section with corresponding parallel facing surfaces.

5. The high impedance circuit of claim 1, wherein there are at least thirty of said anode vanes.

6. A high impedance anode circuit for a magnetron, comprising:

a plurality of first radial vanes disposed in and extending from an anode ring;

a plurality of second radial vanes, interdigitating with said first vanes, disposed in and extending from said anode ring to define a vane structure;

a first strap coaxially disposed along a side of said vane structure, said first strap interconnecting said plurality of first vanes;

a second strap coaxially disposed along said side of said vane structure in facing proximity with said first strap, said second strap interconnecting said plurality of second vanes, said first and second straps providing a low capacitance; and said plurality of first and second vanes each having a respective high inductance portion adjacent said anode ring and a respective high capacitive portion extending from said high inductance portion, said high inductance portion being longer than said high capacitive portion so that said circuit has a high single cavity impedance;

wherein said first vanes and said second vanes respectively are T-shaped.

7. A high impedance anode circuit for a magnetron, comprising:

a plurality of T-shaped anode vanes disposed in and extending radially inward from an anode ring, each of said vanes having a respective wide high capacitance portion and a respective narrow high inductance portion disposed with and extending radially outward from said wide portion, wherein said narrow portion connects said vanes to said anode ring and wherein said high inductance portion is longer than said high capacitance portion;

a first strap, coaxially disposed along an edge of said vanes, said first strap interconnecting alternating ones of said vanes; and a second strap coaxially disposed along said edge of said vanes, said second strap interconnecting remaining ones of said vanes not interconnected by said first strap, said first and second straps providing a low capacitance with respect to each other and with respect to adjacent ones of said vanes;

wherein said first and second straps each having a respective rectangular cross-section with corresponding parallel facing surfaces.

8. A high impedance anode circuit for a magnetron, comprising:

a plurality of first radial vanes disposed in and extending from an anode ring;

a plurality of second radial vanes, interdigitating with said first vanes, and disposed in and extending from said anode ring to define a vane structure;

a first strap coaxially disposed along a side of said vane structure, said first strap interconnecting said plurality of first vanes;

a second strap coaxially disposed along said side of said vane structure in facing proximity with said first strap, said second strap interconnecting said plurality of second vanes, said first and second straps each providing a low capacitance; and said plurality of first and second vanes each having a respective high inductance portion adjacent said anode ring and respective high capacitance portion extending from said high inductance portion, said high inductance portion being longer than said high capacitance portion so that said circuit provides a high single cavity impedance.

9. The high impedance circuit of claim 8, wherein said first and second straps each have a rectangular cross-section.

10. The high impedance circuit of claim 8, wherein said first and second straps each have a crescent shaped cross-section.

11. The high impedance circuit of claim 8, wherein there are at least thirty of said anode vanes.

12. A high impedance anode circuit for a magnetron, comprising:

a plurality of first radial vanes disposed in and extending from an anode ring;

a plurality of second radial vanes, interdigitating with said first vanes, disposed in and extending from said anode ring to define a vane structure;

a first strap interconnecting said plurality of first vanes;

a second strap interconnecting said plurality of second vanes, said first and second straps each having a respective rectangular cross-section with substantially corresponding parallel facing surfaces;

said plurality of first and second vanes each having a respective high inductance portion adjacent said anode ring and a respective high capacitive portion extending from said high inductance portion, said high inductance portion being longer than said high capacitive portion so that said circuit has a high single cavity impedance;

wherein said first vanes and said second vanes respectively are T-shaped.

* * * * *